US011685586B2

(12) United States Patent
Leiberman

(10) Patent No.: US 11,685,586 B2
(45) Date of Patent: Jun. 27, 2023

(54) INFLATABLE PACKAGING STRUCTURE AND METHOD OF FORMING THEREOF

(71) Applicant: Aeris Protective Packaging Inc., Montréal (CA)

(72) Inventor: Michael Leiberman, Montreal (CA)

(73) Assignee: Aeris Protective Packaging Inc., Montreal (CA)

( * ) Notice: Subject to any disclaimer, the term of this patent is extended or adjusted under 35 U.S.C. 154(b) by 163 days.

(21) Appl. No.: 17/177,688

(22) Filed: Feb. 17, 2021

(65) Prior Publication Data

US 2021/0276782 A1 Sep. 9, 2021

Related U.S. Application Data

(60) Provisional application No. 62/984,890, filed on Mar. 4, 2020.

(51) Int. Cl.
*B65D 81/05* (2006.01)

(52) U.S. Cl.
CPC ..... *B65D 81/052* (2013.01)

(58) Field of Classification Search
CPC ..... B65D 81/052
USPC ..... 206/522
See application file for complete search history.

(56) References Cited

U.S. PATENT DOCUMENTS

| | | | | |
|---|---|---|---|---|
| 8,251,216 | B1 * | 8/2012 | Liao | B65D 81/052 206/522 |
| 8,960,437 | B2 * | 2/2015 | Takenaka | B65D 81/022 383/3 |
| 2015/0090627 | A1 * | 4/2015 | Yoshifusa | B65D 81/058 206/522 |
| 2015/0144520 | A1 * | 5/2015 | Liao | B65D 81/052 206/522 |

* cited by examiner

*Primary Examiner* — Jacob K Ackun

(57) ABSTRACT

An inflatable packaging structure, including at least one inflatable panel made of a plurality of layers of thermoplastic material, the at least one inflatable panel includes a plurality of fluid chambers, whereas a one-way check valve is incorporated into at least one of the plurality of fluid chambers, an air supply line, configured to commonly communicate with each of the one-way check valves to supply fluid into the fluid chambers; and at least two heat sealed edges formed on the at least one inflatable panel, each of which is configured to attach a portion of the at least one inflatable panel to another portion thereof; and wherein the at least two heat sealed edges extend generally in parallel with respect to each other and configured to form the inflatable packaging structure with at least partially rectangular cross-section, having at least four faces.

7 Claims, 14 Drawing Sheets

INFLATABLE PACKAGING STRUCTURE AND METHOD OF FORMING THEREOF

FIELD OF THE INVENTION

The present invention relates to a packaging structure, and more particularly, to an inflatable packaging structure that is adapted to be placed on a corner of a device and having improved shock absorbing capabilities.

BACKGROUND OF THE INVENTION

During a product shipping, foam, bubble wrap or cardboard are usually used to protect electronics from damage during handling and transportation.

An inflatable packaging structure is known in the art and includes a plurality of fluid containers, which contain liquid or gas, such as air, which is sealingly entrapped within each of the fluid containers by means of a one-way check-valve. There are multiple advantages in such inflatable packaging structures over the foam, bubble wrap or cardboard packaging, such as for example: reduced storage space is required for the inflatable packaging when it is stored in a non-inflated state; inflatable packaging structure does not produce any contaminations or debris; suspension or impact absorbance is increased in inflatable packaging structures, as compared with other known types of packaging, such as foam, bubble wrap or cardboard, this is partially due to the fact that the protected device, such as a laptop, computer screen or TV screen, is spaced from the walls of the box in which it is being delivered, thus preventing direct impact to be applied upon.

SUMMARY OF THE INVENTION

The present invention seeks to provide an improved inflatable packaging structure.

There is thus provided in accordance with an embodiment of the present invention an inflatable packaging structure, including an inflatable packaging structure, comprising at least one inflatable panel made of a plurality of layers of thermoplastic material; the at least one inflatable panel includes a plurality of fluid chambers, whereas a one-way check valve is incorporated into at least one of the plurality of fluid chambers; an air supply line, configured to commonly communicate with each of the one-way check valves to supply fluid into the fluid chambers; and at least two heat sealed edges formed on the at least one inflatable panel, each of which is configured to attach a portion of the at least one inflatable panel to another portion thereof; and wherein the at least two heat sealed edges extend generally in parallel with respect to each other and configured to form the inflatable packaging structure with at least partially rectangular cross-section, having at least four faces.

Preferably, at least two of the at least four faces extend transversely with respect to each other. Further preferably, a corner is defined between three of the at least four faces, whereas the three faces generally extend at 90 degrees with respect to each other. Still further preferably, the structure includes inflatable and non-inflatable portions. Yet further preferably, the non-inflatable portions are disposed within the rectangular structure defined by the at least four faces.

In accordance with an embodiment of the present invention, the rectangular structure defines a rectangular opening formed between the at least four faces. Preferably, the rectangular opening is adapted for receiving a portion of an object to be protected thereinto.

In accordance with an embodiment of the present invention, a precursor for forming an inflatable packaging structure, comprising at least one inflatable panel made of a plurality of layers of thermoplastic material, arranged along a longitudinal axis; the at least one inflatable panel includes a plurality of fluid chambers, whereas a one-way check valve is incorporated into at least one of the plurality of fluid chambers; an air supply line, configured to commonly communicate with each of the one-way check valves to supply fluid into the fluid chambers; and a first folding line provided on the at least one inflatable panel and arranged in parallel to the longitudinal axis; a second folding line and third folding line provided on the at least one inflatable panel and extending generally in parallel with respect to each other and generally transversely with respect to the first folding line; and wherein a portion of the first folding line is configured to be folded over a portion of the second folding line and heat sealed thereto and another portion of the first folding line is configured to be folded over a portion of the third folding line and heat sealed thereto, thereby forming the inflatable packaging structure as a rectangle.

Preferably, both the second folding line and the third folding line have an intersection point with the first folding line. Further preferably, the precursor is adapted to be folded at the intersection points such that the portion of the first folding line is aligned with the portion of the second folding line and the another portion of the first folding line is aligned with the third folding line.

In accordance with an embodiment of the present invention, a method of forming an inflatable packaging structure, comprising the steps of providing at least one inflatable panel made of a plurality of layers of thermoplastic material, arranged along a longitudinal axis, wherein the at least one inflatable panel includes a plurality of fluid chambers and a one-way check valve is incorporated into at least one of the plurality of fluid chambers and an air supply line, configured to commonly communicate with each of the one-way check valves to supply fluid into the fluid chambers; and providing a first folding line on the inflatable panel, which is arranged in parallel to the longitudinal axis; providing a second folding line and third folding line on the inflatable panel, which extend generally in parallel with respect to each other and generally transversely with respect to the first folding line; fold a portion of the first folding line over a portion of the second folding line and heat seal the two portions; fold another portion of the first folding line over a portion of the third folding line and heat seal the two portions to form the inflatable packaging structure in a rectangular shape having at least four faces and an opening therebetween and at least one trim extending from at least one face and directed externally with respect to the opening.

Preferably, further comprising the step of inverting the inflatable packaging structure, such that the at least one trim extends internally from at least one face into the opening. Further preferably, comprising the step of inflating the at least four faces of the inflatable packaging structure. Still further preferably, the folding of the portion of the first folding line over the portion of the second folding line involves folding of the precursor at 45 degrees with respect to the longitudinal axis. Yet further preferably, the folding of the anther portion of the first folding line over the portion of the third folding line involves folding of the precursor at 45 degrees with respect to the longitudinal axis.

BRIEF DESCRIPTION OF THE DRAWINGS

The present invention will be understood and appreciated more fully from the following detailed description, taken in conjunction with the drawings in which.

DETAILED DESCRIPTION OF EMBODIMENTS OF THE INVENTION

The present invention preferably includes an inflatable packaging structure adapted to be mounted on a corner of an object to be protected during shipping thereof, specifically useful for protecting a fragile object, such as electronics.

The inflatable packaging structure in accordance with an embodiment of the present invention is prepared by forming a package precursor and thereby converting it into a finished inflatable packaging structure, whereas the dimensions of the inflatable packaging structure are customizable in accordance with the dimensions of the object to be protected.

Figure 1:
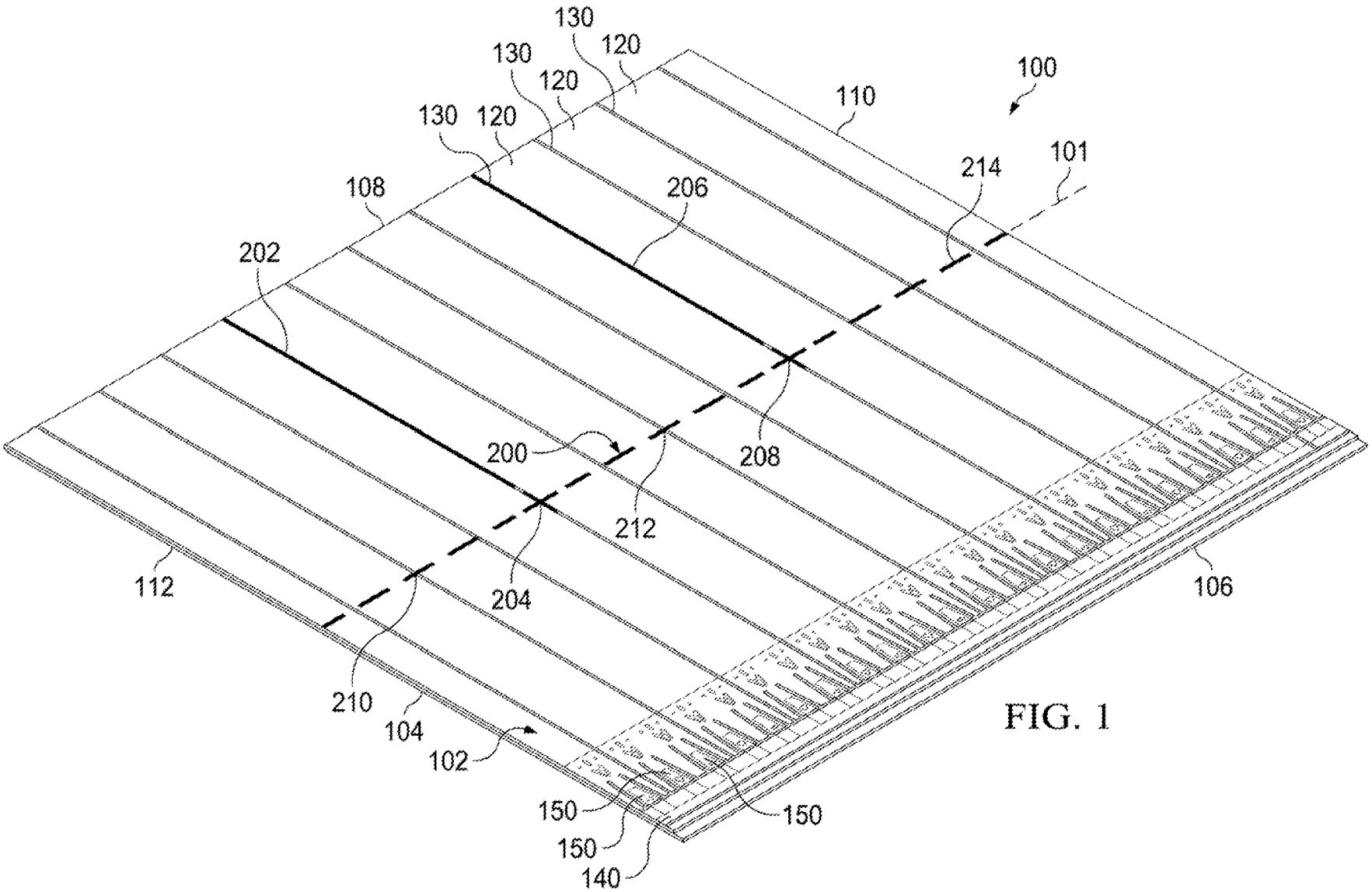
FIG. 1 is a simplified pictorial illustration of a precursor of an inflatable packaging structure before formation thereof, constructed and operative in accordance with an embodiment of the present invention.

Reference is now made to FIG. 1, which is a simplified pictorial illustration of a precursor of an inflatable packaging structure before formation thereof, constructed and operative in accordance with an embodiment of the present invention.

FIG. 1 shows a precursor 100 of an inflatable packaging structure. The precursor 100 is made of a thermoplastic material, such as polyethylene and is arranged along a longitudinal axis 101. It is noted that the precursor 100 is preferably of a rectangular shape and is composed of two thermoplastic films 102 and 104, which are heat-sealingly bonded along the perimeter of the rectangle, such as to form two parallel edges 106 and 108, which extend in parallel to the longitudinal axis 101 and two parallel edges 110 and 112, which extend perpendicularly with respect to longitudinal axis 101.

A plurality of air chambers 120 is formed between layers 102 and 104 of the precursor 100. It is seen that each of the air chambers 120 is oriented perpendicularly with respect to longitudinal axis 101 and extends from edge 106 to edge 108. Each air chamber 120 is disposed adjacent to another, and the plurality of air chambers 120 extends along the entire longitudinal extent provided between edge 110 and edge 112 of the precursor 100. Each of the air chambers 120 is separated from another by means of a heat seal line 130.

It is seen particularly in FIG. 1 that an air supply line 140 is provided along edge 106 of the precursor 100 and a filling valve (not shown) is incorporated at one side of the air supply line 140. A one-way check valve 150 is preferably mounted within each of the air chambers 120 and is configured to enable air passage from the air supply line 140 into the inner volume of each of the respective air chambers 120 and to prevent air passage from the inner volume of each of the respective air chambers 120.

It is noted that the air is configured to be supplied to the air supply line 140 from an exterior source, such as a pump, through the filling valve and further distributed through the plurality of one-way check valves 150 into each of the plurality of air chambers 120 of the precursor 100 in order to inflate the precursor 100, due to the fact that the air supply line 140 commonly communicates with all of the one-way check valves 150.

It is noted that any fluid, i.e. liquid or gas, can alternatively be used for inflation of the precursor 100.

It is noted that each of the air chambers 120 operate independently due to the fact that each of the air chambers 120 is provided with a separate one-way check valve 150. In case one of the air chambers 120 is ruptured, the remaining air chambers remain intact.

The method of formation of the precursor 100 into a final inflatable packaging structure is further described in detail hereinbelow with reference to FIGS. 2-8.

It is a particular feature of an embodiment of the present invention that folding lines are marked on the precursor 100 for manual heat sealing in these pre-designated places in accordance with the desired dimensions.

It is particularly seen that a first folding line 200 is marked on the precursor 100 and is oriented generally in parallel to longitudinal axis 101 and to edges 106 and 108. A second folding line 202 is marked on the precursor 100 and is oriented generally in parallel to edges 110 and 112, thus the second folding line 202 is oriented transversely with respect to the longitudinal axis 101 and thus intersect the first folding line 200 at a first point of rotation 204. A third folding line 206 is marked on the precursor 100 and is oriented generally in parallel to the second folding line 202. The third folding line 206 is spaced from the second folding line 202 and intersects the first folding line 200 at a second point of rotation 208.

Preferably, the second folding line 202 and the third folding line 206 each intersects the first folding line 200 at an angle of 90 degrees, however it is appreciated that each of the second and third folding lines 202 and 206 may intersect the first folding line 200 at a range of angles, preferably varying between 85 degrees and 95 degrees in accordance with an embodiment of the present invention.

It is noted that the first folding line 200 may be positioned anywhere between edges 106 and 108. Second and third folding lines 202 and 206 may be positioned anywhere between edges 110 and 112, all according to the desired dimensions that are required for protecting a particular object during shipment thereof.

It is seen in FIG. 1 that the first folding line 200 has several segments, a first segment 210 disposed between edge 112 and the first point of rotation, a second segment 212 disposed between the first and the second points of rotation 204 and 208. A third segment 214 disposed between the second point of rotation 208 and edge 110.

Preferably, the second folding line 202 is spaced from edge 112 to the same longitudinal extent as the third folding line 206 is spaced from edge 110. Alternatively, each of the second and the third folding lines 202 and 206 may be formed at a different location with respect to their respective edges, such that the second folding line 202 is farther away or closer to edge 112 than the third folding line 206 is to edge 110.

It is a particular feature of an embodiment of the present invention that the second folding line 202 and the third folding line 206 preferably extend generally in parallel with respect to each other and each of the folding lines 202 and 206 extends along at least a portion of the width of the precursor defined between edge 108 and edge 106 and intersects with the first folding line 200.

It is seen in FIG. 1 that the precursor 100 is illustrated in way that layer 102 faces upwardly.

Figure 2:
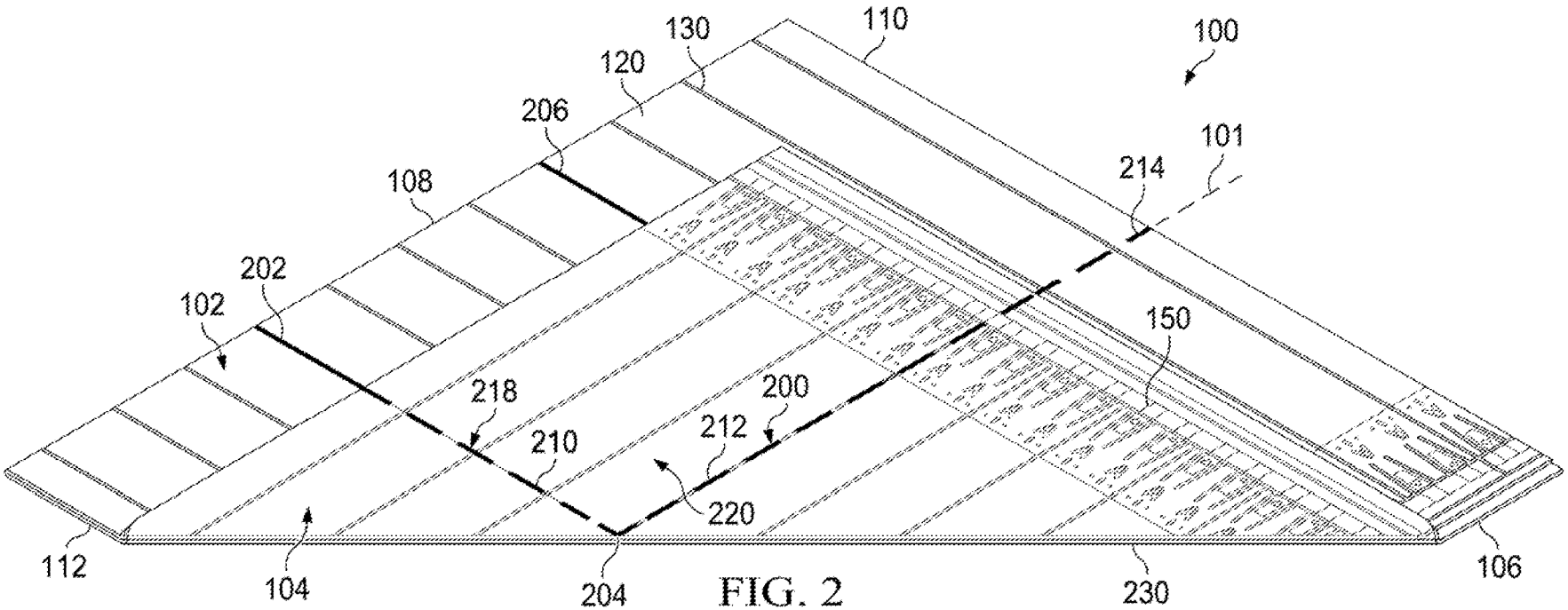
FIG. 2 is a simplified pictorial illustration of the precursor of FIG. 1 shown in a first formation stage.

Reference is now made to FIG. 2, which is a simplified pictorial illustration of the precursor 100 of FIG. 1 shown in a first formation stage.

It is seen in FIG. 2 that at the first stage of formation of the precursor 100 of FIG. 1, the precursor 100 is folded about the first point of rotation 204, such that the first segment 210 of the first folding line 200 is aligned with at least a portion of the second folding line 202, thereby forming a precursor of a first sealing edge 218 at the engagement area therebetween.

It is noted that the precursor 100 is folded such that at least a portion of edge 112 and at least a portion of edge 106 are folded over, thus resulting in a first folded portion 220, which is folded on top of layer 102 of the precursor 100. The first folded portion 220 has the layer 104 facing upwardly, as illustrated in FIG. 2. The first folded portion 220 is defined by at least a portion of edge 112, at least a portion of edge 106 and an edge 230.

It is a particular feature of an embodiment of the present invention that the edge 230 is typically disposed at an angle of 45 degrees with respect to the longitudinal axis 101, however it is appreciated that the edge 230 may be disposed at a range of angles with respect to longitudinal axis 101, preferably varying between 40 degrees and 50 degrees in accordance with an embodiment of the present invention.

Figure 3A:
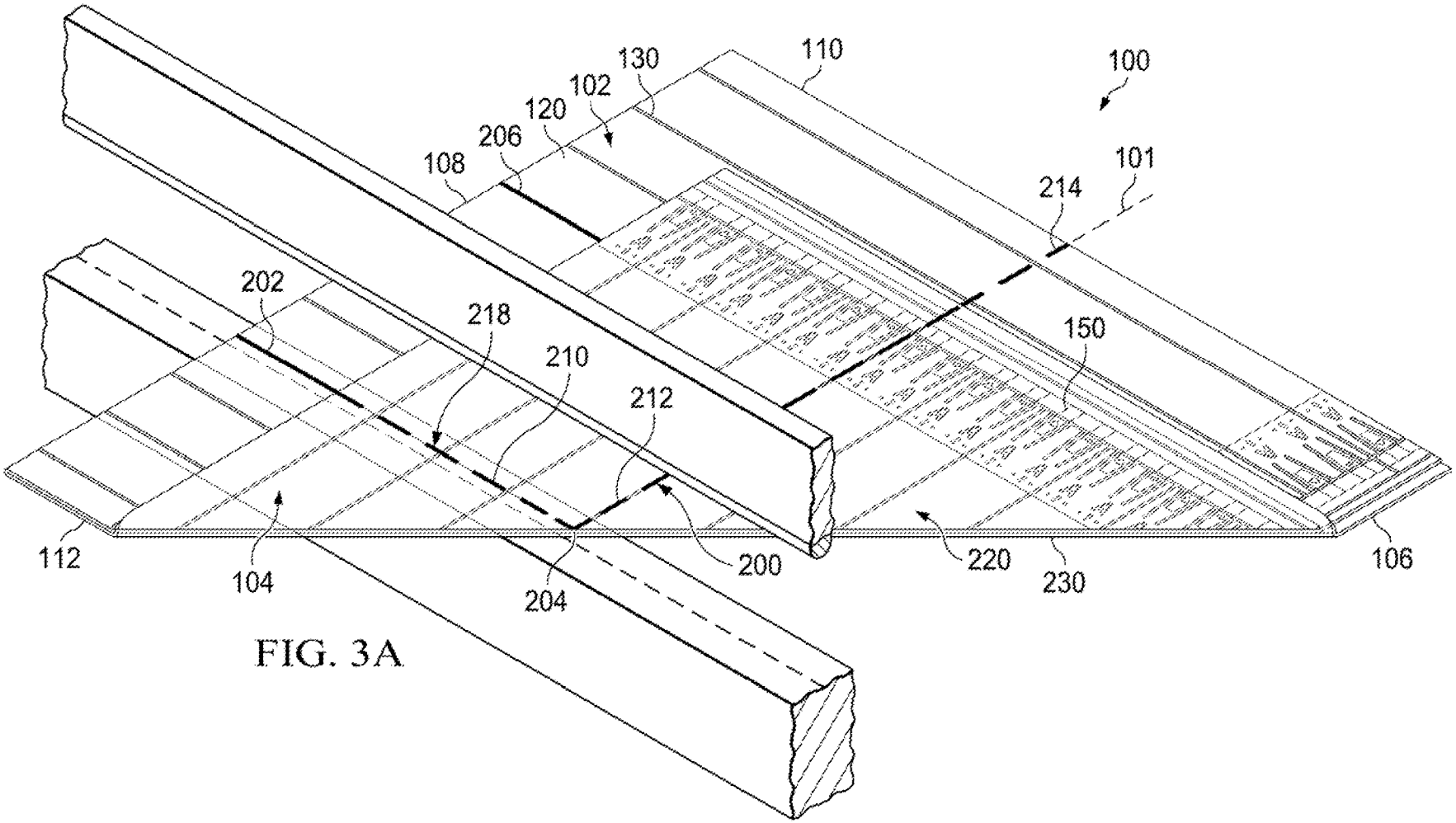
FIGS. 3A-3C are simplified pictorial illustrations of the precursor of FIG. 1 in the process of a second formation stage and the resulting structure at the end of the second formation stage.
Figure 3B:
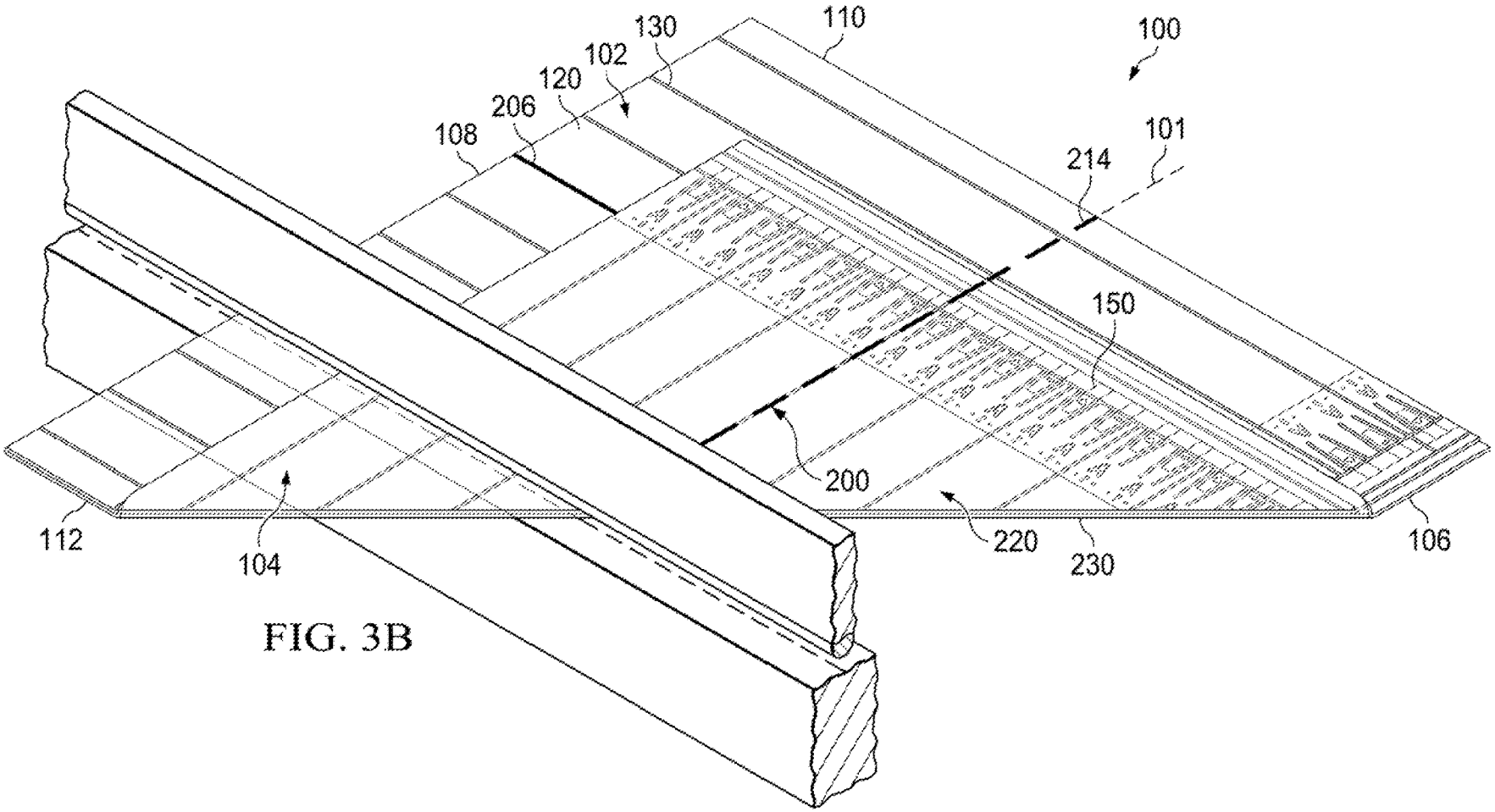
Figure 3C:
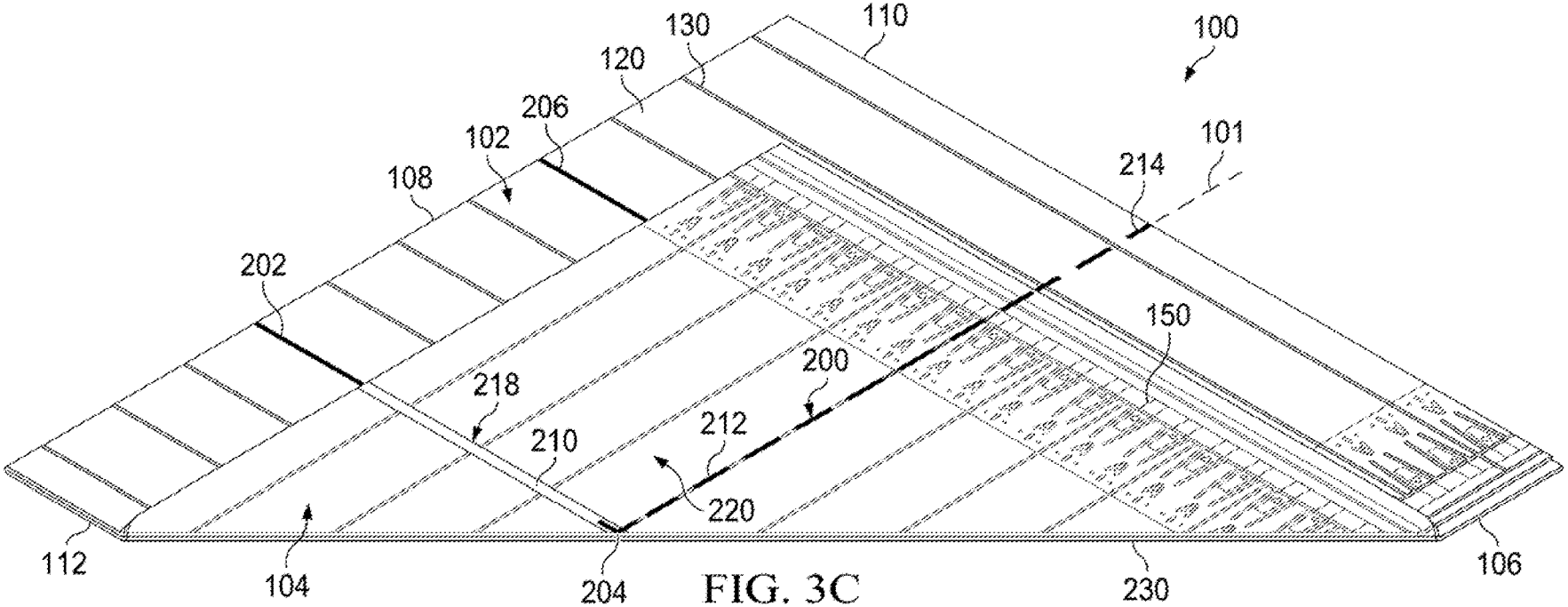

Reference is now made to FIGS. 3A-3C, which are simplified pictorial illustrations of the precursor 100 of FIG. 1 in the process of a second formation stage and the resulting structure at the end of the second formation stage.

The precursor is seen in FIG. 3A in preparation to heat sealing of the precursor of sealing edge 218. It is particularly seen in FIG. 3B how a heat sealed edge is formed along the precursor of sealing edge 218 by applying heat along the precursor of sealing edge 218, thereby bonding the triangular portion 220 to the remaining generally rectangular portion of the precursor 100 along the precursor of sealing edge 218.

FIG. 3C particularly illustrates the resulting precursor following the second formation stage thereof, where it is seen that an edge of the triangular portion 220 is bonded to the remaining rectangular portion of the precursor 100.

Figure 4:
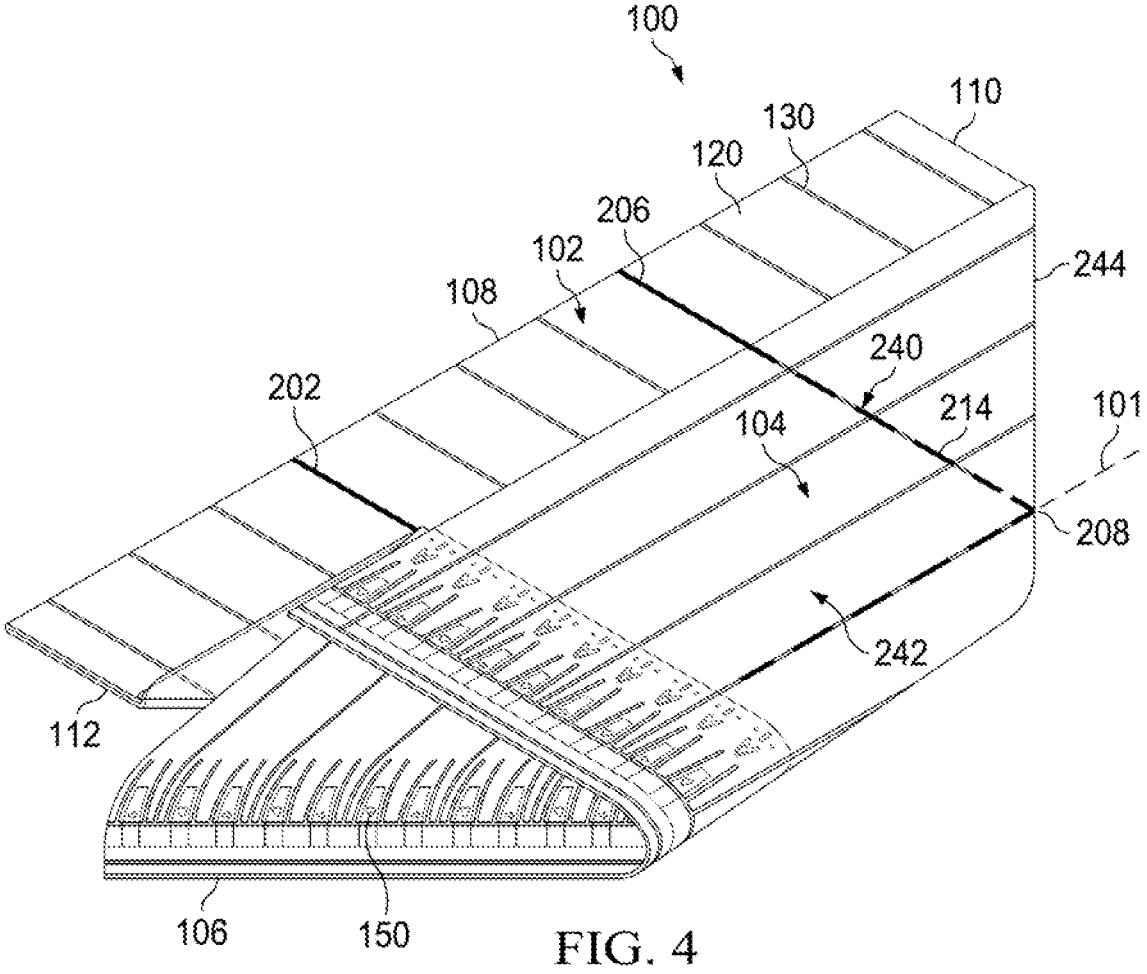
FIG. 4 is a simplified pictorial illustration of the precursor of FIG. 1, shown in a third formation stage.

Reference is now made to FIG. 4, which is a simplified pictorial illustration of the precursor 100 of FIG. 1, shown in a third formation stage.

It is seen in FIG. 4 that following the second stage of formation as shown in FIG. 3C, the precursor 100 is folded again about the second point of rotation 208, such that the third segment 214 of the first folding line 200 is aligned with at least a portion of the third folding line 206, thereby forming a precursor of a second sealing edge 240 at the engagement area therebetween.

It is noted that the precursor 100 is folded over such that at least a portion of edge 110 and at least a portion of edge 106 are folded over, thus resulting in a second folded portion 242, which is folded on top of layer 102 of the precursor 100. The second folded portion 242 has the layer 104 facing upwardly, as illustrated in FIG. 4. The second folded portion 242 is at least partially defined by a portion of edge 110 and an edge 244.

It is a particular feature of an embodiment of the present invention that the edge 244 is typically disposed at an angle of 45 degrees with respect to the longitudinal axis 101, however it is appreciated that the edge 244 may be disposed at a range of angles with respect to longitudinal axis 101, preferably varying between 40 degrees and 50 degrees in accordance with another embodiment of the present invention.

It is noted that the third formation stage of precursor 100 as shown in FIG. 4 is preferably similar to the second formation stage of the precursor 100 as shown in FIG. 2, in as much that these are two symmetrical folding stages, due to the fact that the second and third folding lines 202 and 206 are equally spaced from their respective edges 112 and 110. In FIG. 2, it is shown that one side of the precursor 100 is folded on top of layer 102 of the precursor 100. In FIG. 4, it is shown that another side of the precursor 100 is folded on top of layer 102 of the precursor 100. Alternatively, as noted hereinabove, the second folding line 202 may be provided at a different distance from edge 112 than the third folding line 206 is spaced from edge 110.

Figure 5A:
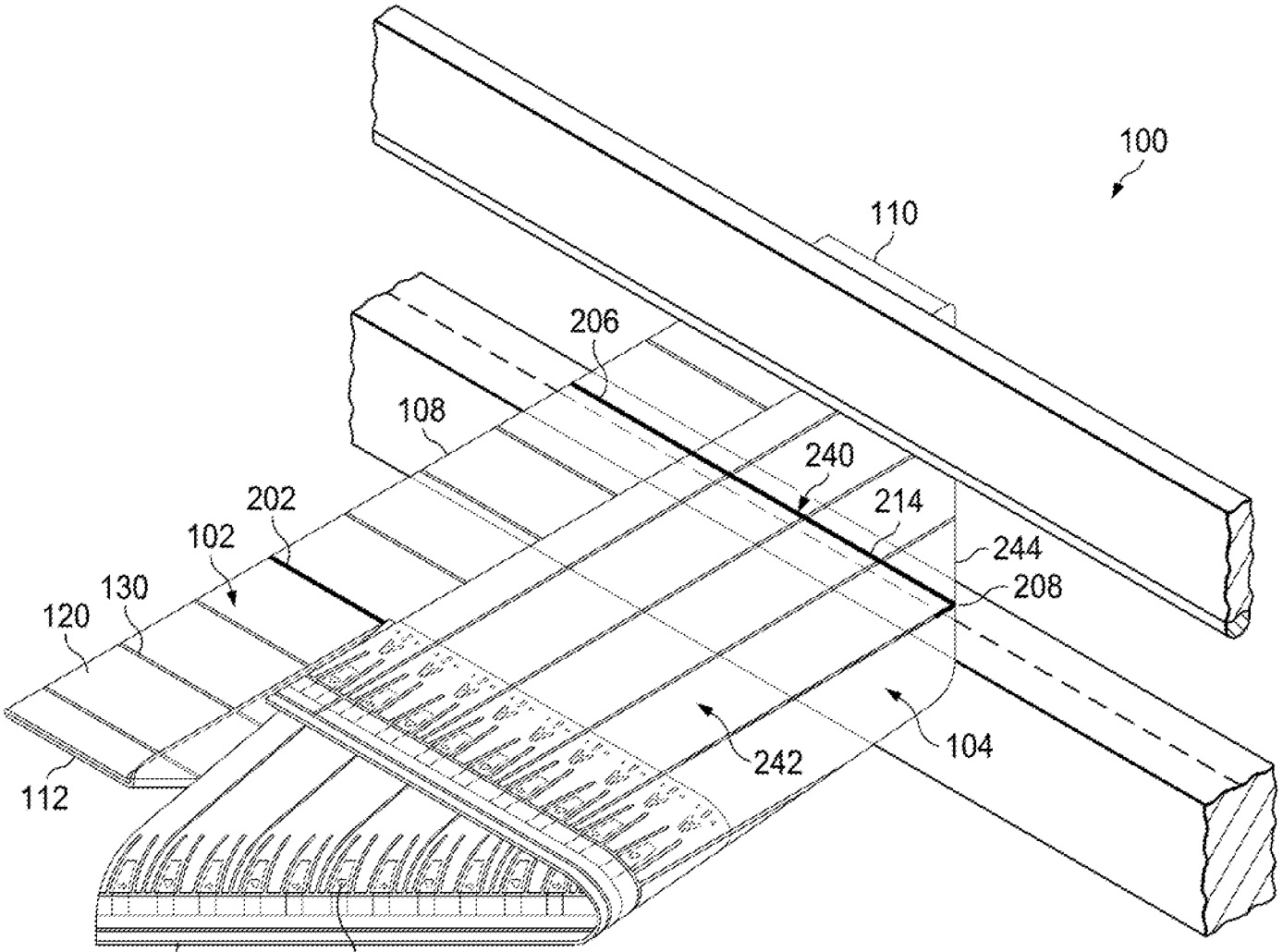
FIGS. 5A-5C are simplified pictorial illustrations of the precursor of FIG. 1 in the process of a fourth formation stage and the resulting structure at the end of the fourth formation stage.
Figure 5B:
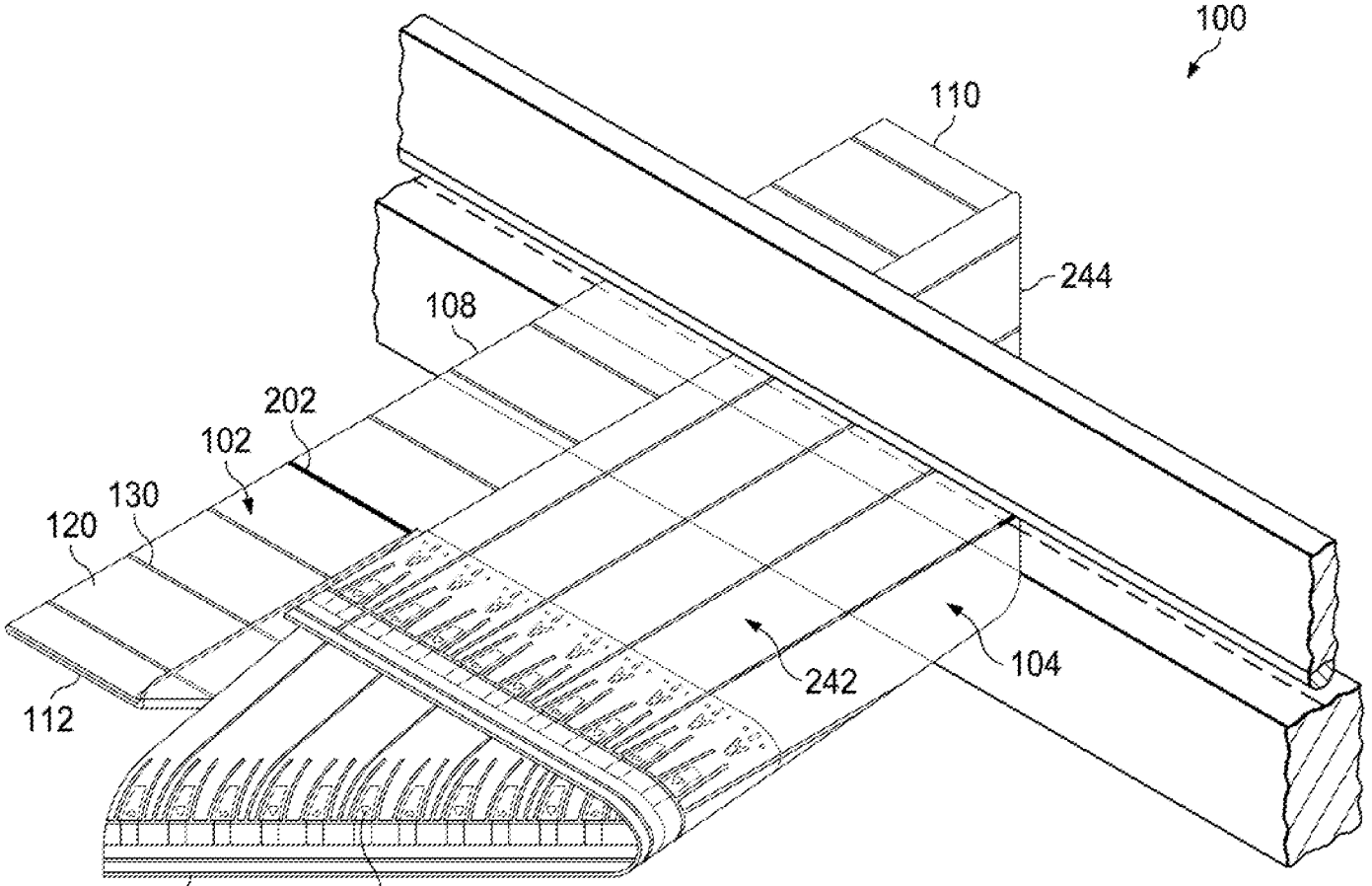
Figure 5C:
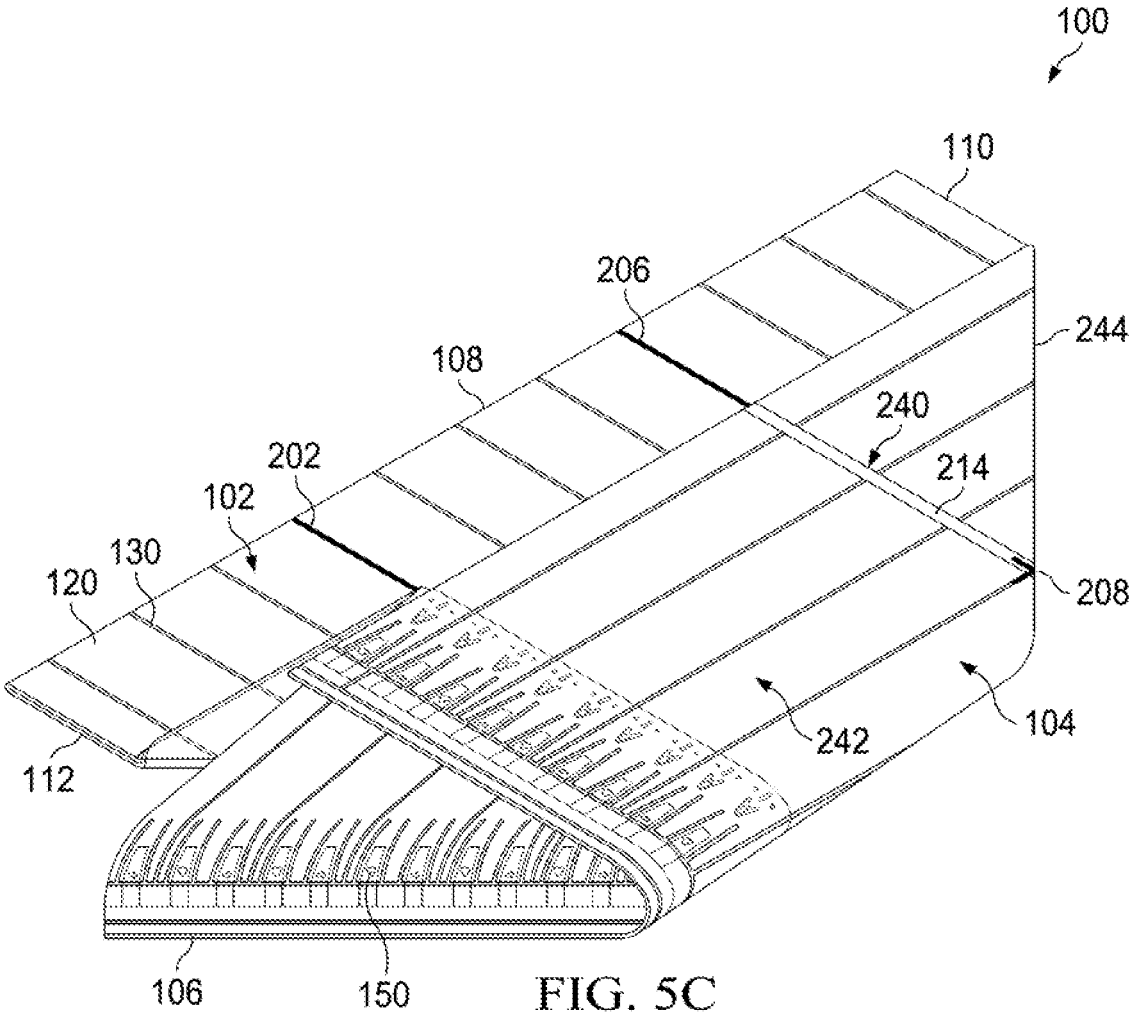

Reference is now made to FIGS. 5A-5C, which are simplified pictorial illustrations of the precursor 100 of FIG. 1 in the process of a fourth formation stage and the resulting structure at the end of the fourth formation stage.

The precursor is seen in FIG. 5A in preparation to heat sealing of the second precursor of sealing edge 240. It is particularly seen in FIG. 5B how a heat sealed edge is formed along the precursor of sealing edge 240 by applying heat along the precursor of sealing edge 240, thereby bonding the second folded portion 242 to the remaining portion of the precursor 100 along the precursor of sealing edge 240.

FIG. 5C particularly illustrates the resulting precursor following the fourth formation stage thereof, where it is seen that an edge of the second folded portion 242 is bonded to the remaining portion of the precursor 100.

Figure 6:
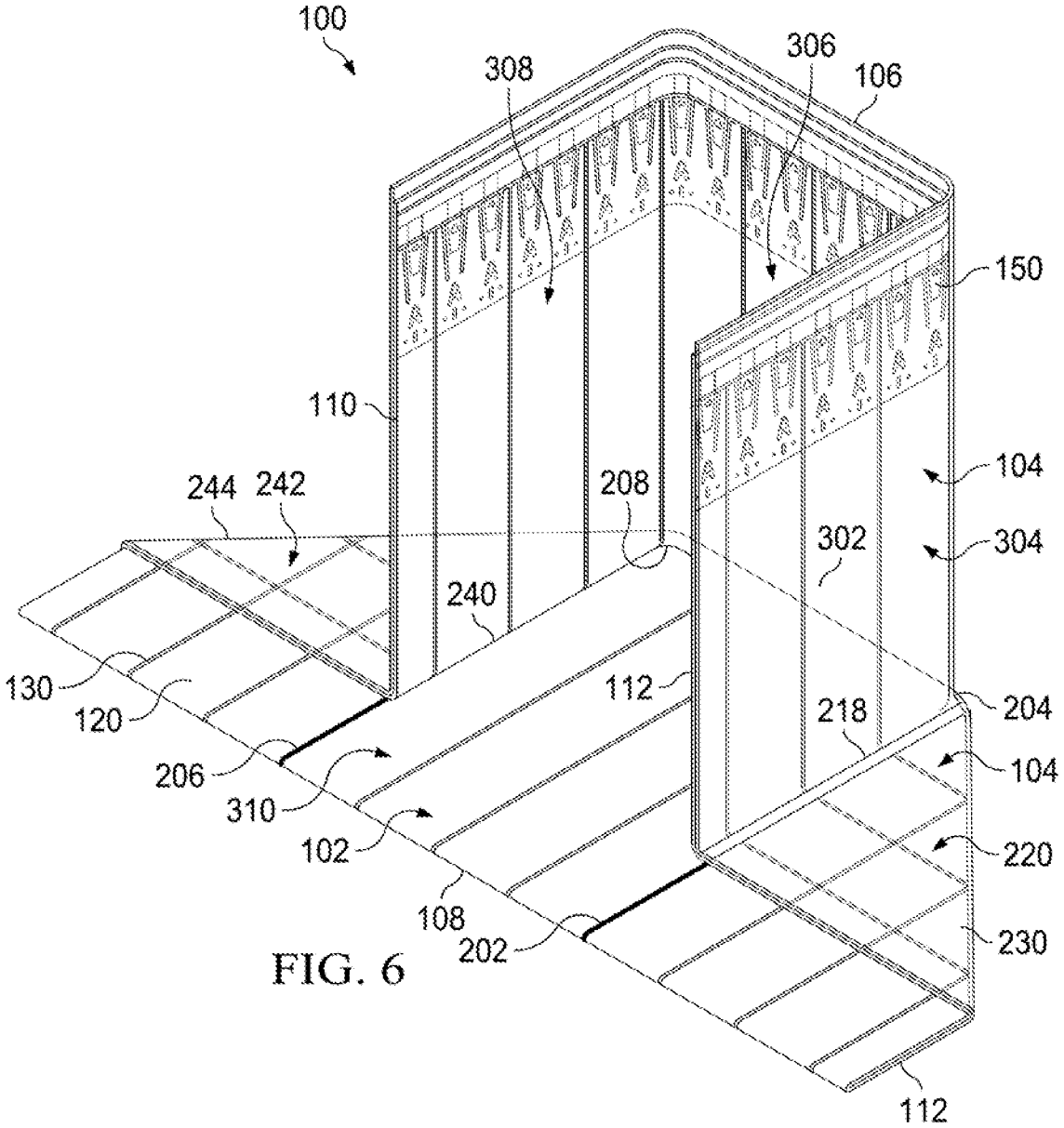
FIG. 6 is a simplified pictorial illustration of the resulting inflatable packaging structure following the fourth formation stage shown in FIGS. 5A-5C.

Reference is now made to FIG. 6, which is a simplified pictorial illustration of the resulting inflatable packaging structure following the fourth formation stage shown in FIGS. 5A-5C.

It is seen in FIG. 6 that following the fourth formation stage of the precursor 100, the folded portion 242 is pulled upwards, thereby providing a generally open rectangular inflatable packaging structure 300 having two trims extending outwardly therefrom. The circumference of the open rectangular inflatable packaging structure 300 is defined by edge 106, edge 112, first sealing edge 218, edge 302 extending along the second segment 212 of the first folding line 200, second sealing edge 240 and edge 110. Each of the trims is a portion of folding portion 220 and 242 respectively. The first trim is defined by sealing edge 218, edge 230 and portions of edges 112 and 108. The second trim is defined by sealing edge 240, edge 244 and portions of edges 110 and 108.

It is noted that layer 104 is the outwardly facing surface of the open rectangular inflatable packaging structure 300, as shown in FIG. 6.

It is a particular feature of an embodiment of the present invention that the first sealing edge 218 and the second sealing edge 240 are preferably extend generally in parallel with respect to each other and each of the sealing edges 218 and 240 extends along at least a portion of the width of the precursor defined between edge 108 and edge 106.

It is a particular feature of an embodiment of the present invention that a generally rectangular inflatable packaging structure 300 is formed upon performing the second, third and fourth formation stages on the precursor 100, as described and illustrated with reference to FIGS. 2-6.

It is a further particular feature of an embodiment of the present invention that typically two corners are formed at the inflatable packaging structure 300, one corner is defined by the first point of rotation 204 between the first sealing edge 218 and edge 302 and another corner defined by the second point of rotation 208 between the second sealing edge 240 and edge 302.

The resulting rectangular inflatable packaging structure 300 generally defines three side faces 304, 306 and 308 and a bottom face 310. The first corner is defined between side faces 304 and 306 and bottom face 310. The second corner is defined between side faces 306 and 308 and bottom face 310.

It is a particular feature of an embodiment of the present invention that the faces 304, 306 and 310 of the open rectangular inflatable packaging structure 300 defining the first corner preferably extend at an angle of 90 degrees with respect to each other. Alternatively, the faces 304, 306 and 310 of the open rectangular inflatable packaging structure 300 defining the first corner may extend at an angle within the range of 85 degrees-95 degrees. Similarly, the faces 306, 308 and 310 of the open rectangular inflatable packaging structure 300 defining the second corner preferably extend at an angle of 90 degrees with respect to each other. Alternatively, the faces 306, 308 and 310 of the open rectangular inflatable packaging structure 300 defining the second corner may extend at an angle within the range of 85 degrees-95 degrees.

It is a further particular feature of an embodiment of the present invention that the faces 304, 306, 308 and 310 of the rectangular inflatable packaging structure 300 define a rectangular opening therebetween due to the fact that they are preferably disposed at 90 degrees with respect to each other.

It is noted that a portion of the resulting structure 300 is inflatable and a portion thereof is non-inflatable since the air chambers 120 in certain areas are sealed. Specifically, it is seen that the rectangular structure is inflatable and the folded portions 220 and 242 are non-inflatable since the passage to air chambers of these folded portions are sealed by sealing edges 218 and 240 respectively.

Figure 7:
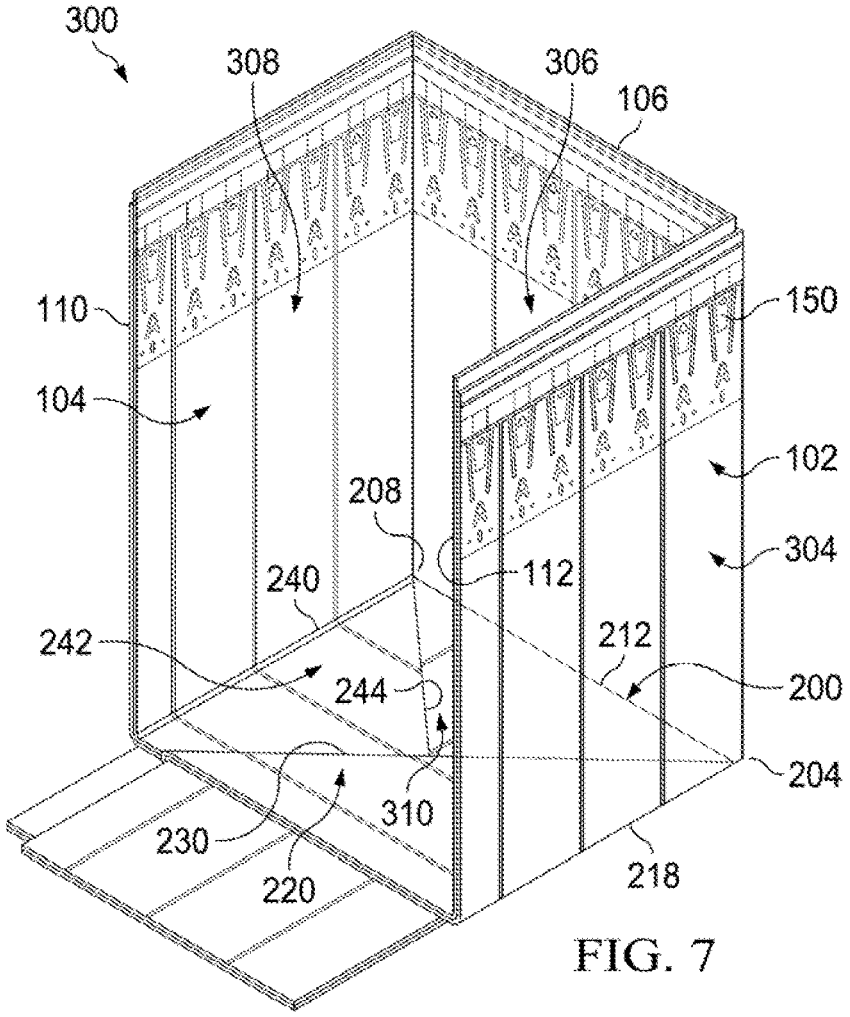
FIG. 7 is a simplified pictorial illustration of the inflatable packaging structure of FIG. 6 in a fifth formation stage.

Reference is now made to FIG. 7, which is a simplified pictorial illustration of the inflatable packaging structure 300 of FIG. 6 in a fifth formation stage.

It is illustrated in FIG. 7 that the inflatable packaging structure 300 of FIG. 6 is inverted inside out, such that the trims of folded portions 220 and 242, which are defined in detail with reference to FIG. 6 are now folded inwards, so that layer 102 is the outwardly facing surface of the open rectangular inflatable packaging structure 300, as shown in FIG. 7.

It is seen in FIG. 7 that the trims of folded portions 220 and 242 now extend inwardly of the perimeter of open rectangular inflatable packaging structure 300 and typically two corners defined by points of rotation 204 and 208 are now located in the interior part of the open rectangular inflatable packaging structure 300, connecting between edge 218 and 302 and 240 and 302 respectively.

It is noted that in this operative orientation shown in FIG. 7, the open rectangular inflatable packaging structure 300 is ready for inflation.

Figure 8:
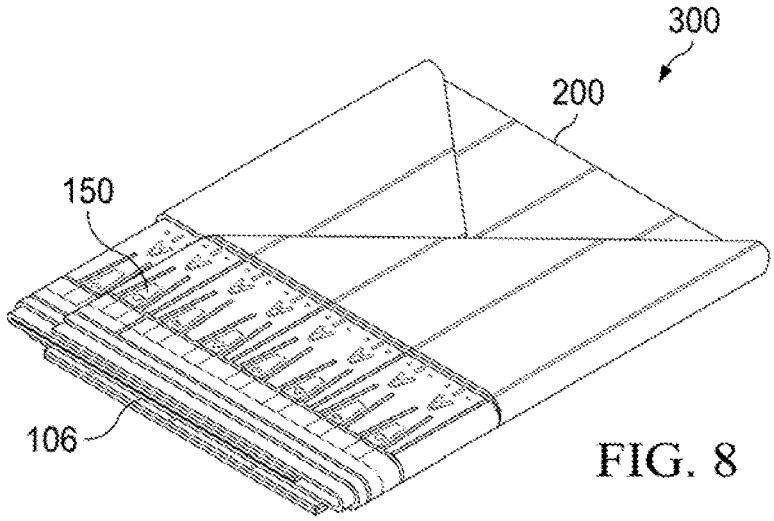
FIG. 8 is a simplified pictorial illustration of the inflatable packaging structure of FIG. 7, shown in a storage folded and non-inflated orientation.

Reference is now made to FIG. 8, which is a simplified pictorial illustration of the inflatable packaging structure 300 of FIG. 7, shown in a storage folded and non-inflated orientation.

It is illustrated in FIG. 8 how the inflatable packaging structure 300 of FIG. 7 may be folded for shipment in order to provide maximum space efficiency.

Figure 9:
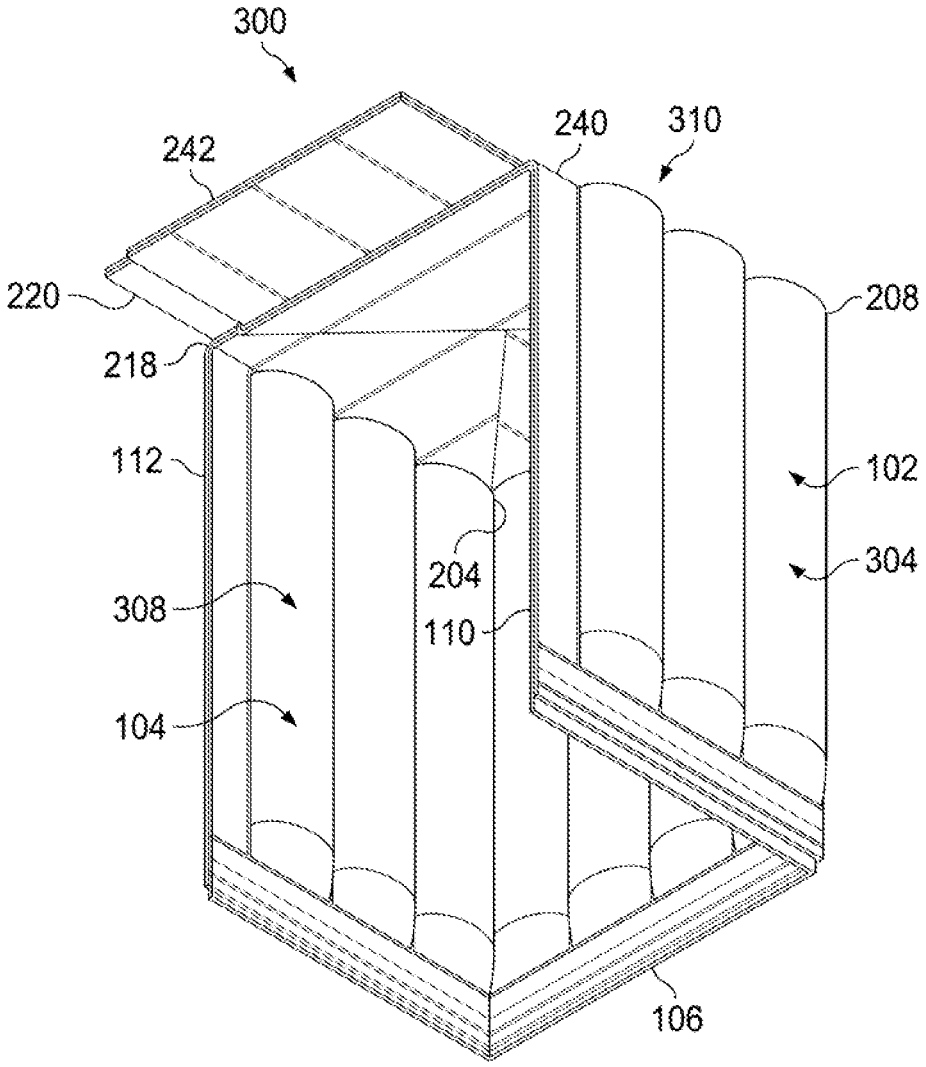
FIG. 9 is a simplified pictorial illustration of the inflatable packaging structure of FIG. 7 in an inflated orientation.

Reference is now made to FIG. 9, which is a simplified pictorial illustration of the inflatable packaging structure 300 of FIG. 7 in an inflated orientation.

The inflatable packaging structure 300 is illustrated in an inflated orientation in FIG. 9, where it is seen that the open rectangular inflatable packaging structure 300 having a circumference defined by faces 304, 306, 308 and 310 is inflated. Typically, two internal corners are provided between the faces 304, 306, 308 and 310 of the open rectangular inflatable packaging structure 300. The first corner is provided between faces 304, 306 and 310, specifically defined by sealing edge 218 and edge 302 and the second corner is provided between faces 306, 308 and 310, specifically defined by sealing edge 240 and edge 302.

It is a particular feature of an embodiment of the present invention that the faces 304, 306 and 310 of the open rectangular inflatable packaging structure 300 defining the first corner preferably extend at an angle of 90 degrees with respect to each other. Alternatively, the faces 304, 306 and 310 of the open rectangular inflatable packaging structure 300 defining the first corner may extend at an angle within the range of 85 degrees-95 degrees. Similarly, the faces 306, 308 and 310 of the open rectangular inflatable packaging structure 300 defining the second corner preferably extend at an angle of 90 degrees with respect to each other. Alternatively, the faces 306, 308 and 310 of the open rectangular inflatable packaging structure 300 defining the second corner may extend at an angle within the range of 85 degrees-95 degrees.

It is a further particular feature of an embodiment of the present invention that the trims of the folding portions 220 and 242 remain non-inflated and thus serve as a protective layer that prevents damaging of the inflatable packaging structure 300 by sharp edges of the protected object.

Figure 10:
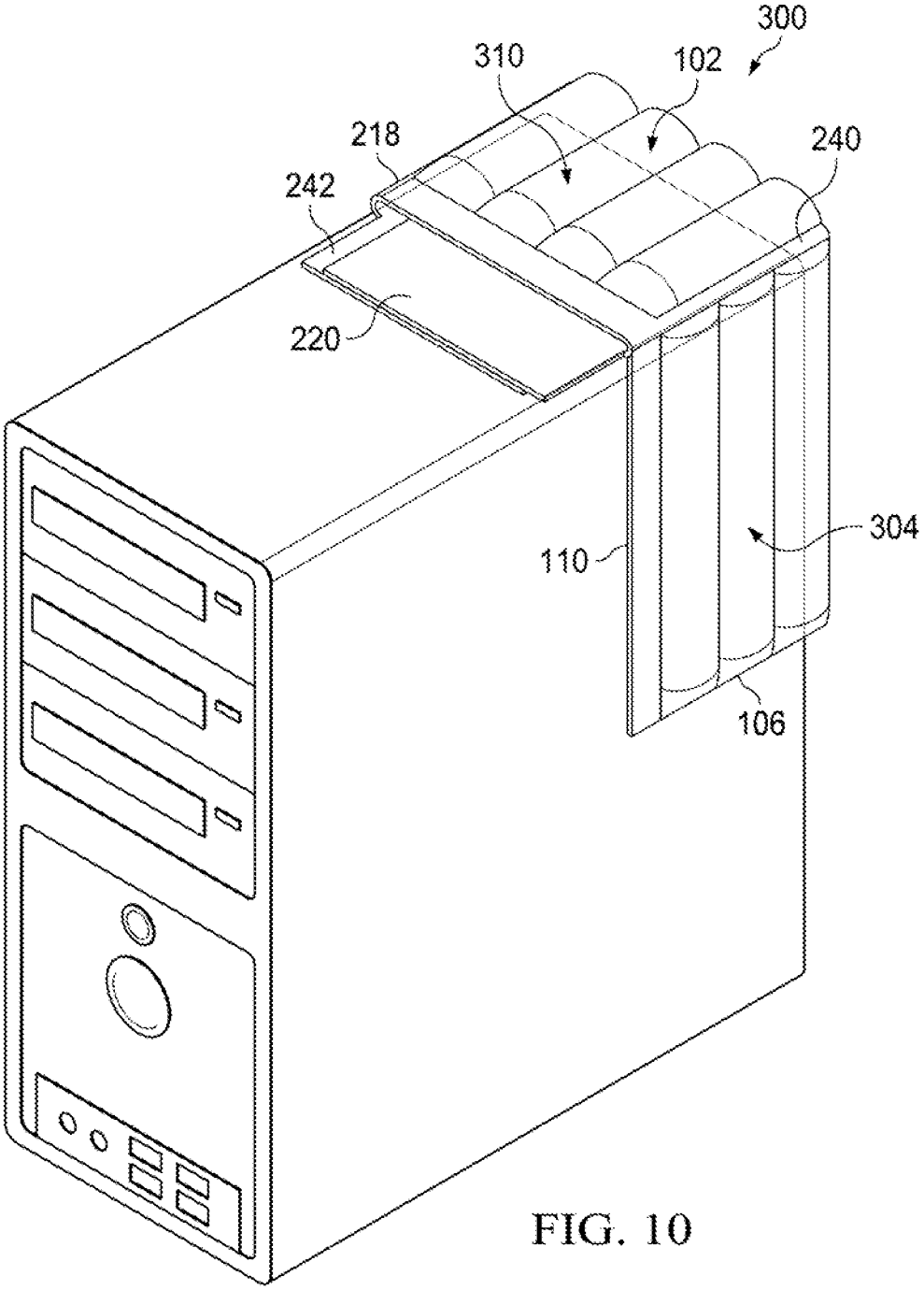
FIG. 10 is a simplified pictorial illustration of the inflatable packaging structure of FIG. 9 mounted onto a computer.

Reference is now made to FIG. 10, which is a simplified pictorial illustration of the inflatable packaging structure 300 of FIG. 9 mounted onto a computer.

The packaging structure 300 in an inflated orientation may be mounted onto a portion of an object to be protected, such as on a computer, as illustrated in an example of FIG. 10. It is appreciated that faces 304, 306, 308 and 310 of the packaging structure overly portions of respective faces of the computer and the corners of the computer are each received within the first and second corners of the packaging structure, each of which is protected by three inflated faces.

It is a particular feature of an embodiment of the present invention that due to the fact that the corners are defined between three faces that generally extend at 90 degrees with respect to each other, the object to be protected is received snugly within the packaging structure 300 and thus enhanced suspension of the object is enabled.

Figure 11:
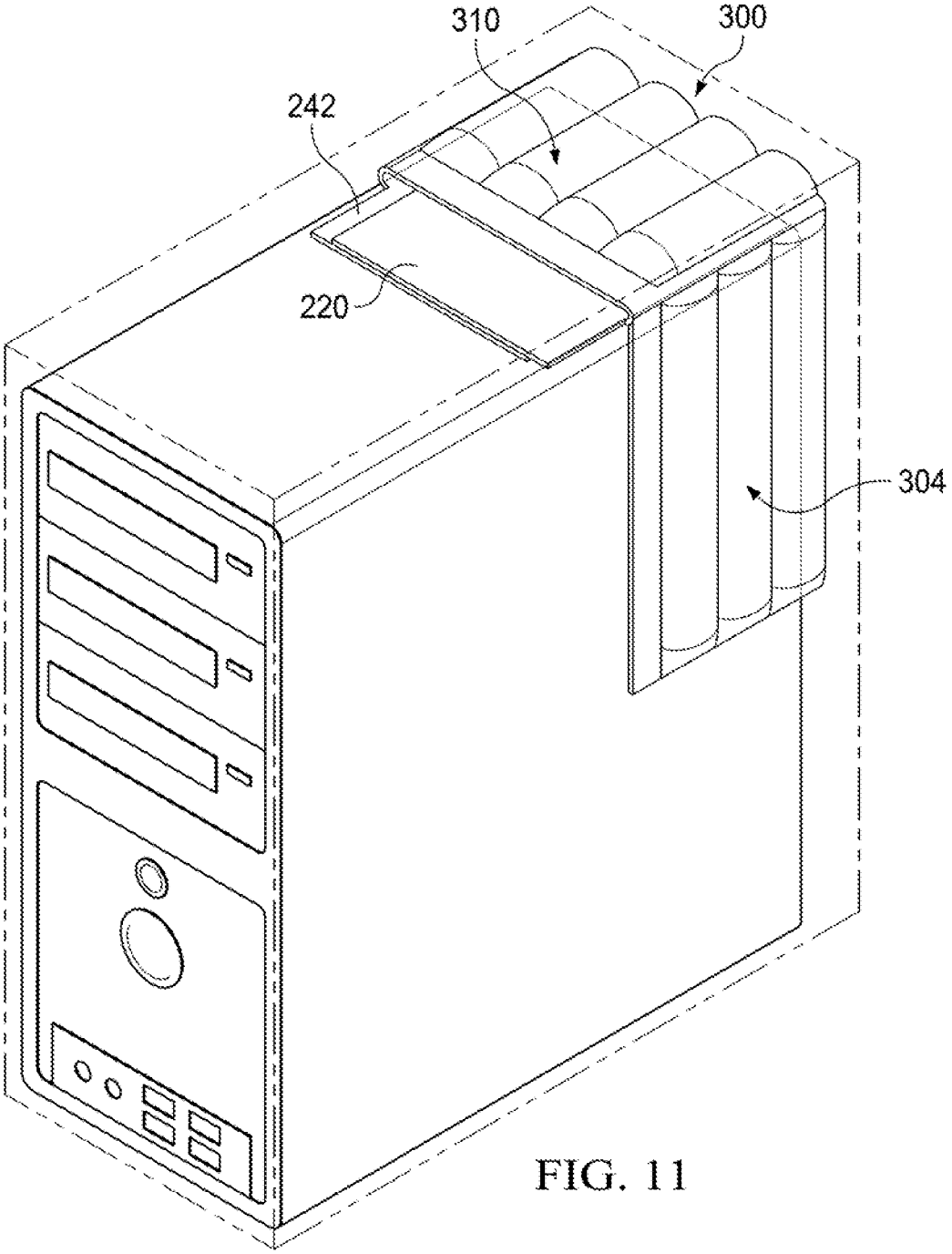
FIG. 11 is a simplified pictorial illustration of the inflatable packaging structure mounted onto a computer as shown in FIG. 10 inserted into a box.

Reference is now made to FIG. 11, which is a simplified pictorial illustration of the inflatable packaging structure 300 mounted onto a computer as shown in FIG. 10 inserted into a box.

It is seen in FIG. 11 that the inflatable packaging structure 300 is mounted on to the object to be protected, such as a computer, which is in turn placed into a box. It is appreciated that a similar inflatable packaging structure 300 may be mounted onto each of the sides of the computer to enhance protection.

It is a particular feature of an embodiment of the present invention that due to the rectangular shape of the packaging structure 300, the object to be protected along with the packaging structures mounted thereon is received snugly within the box and thus enhanced suspension of the object is enabled.

It will be appreciated by persons skilled in the art that the present invention is not limited by what has been particularly shown and described hereinabove. Rather the scope of the present invention includes both combinations and sub-combinations of various features described hereinabove as well as variations and modifications thereof which are not in the prior art.

The invention claimed is:

1. An inflatable packaging structure, comprising:

at least one inflatable panel made of a plurality of layers of thermoplastic material;

said at least one inflatable panel includes a plurality of fluid chambers, whereas a one-way check valve is incorporated into at least one of said plurality of fluid chambers;

an air supply line, configured to commonly communicate with each of said one-way check valves to supply fluid into said fluid chambers; and at least two sealing edges formed on said at least one inflatable panel, each of which is configured to attach a portion of said at least one inflatable panel to another portion thereof; and wherein said at least two sealing edges extend generally in parallel with respect to each other and configured to form said inflatable packaging structure with at least partially rectangular cross-section, having at least four faces.

2. The inflatable packaging structure according to claim 1 and wherein at least two of said at least four faces extend transversely with respect to each other.

3. The inflatable packaging structure according to claim 1 and wherein a corner is defined between three of said at least four faces, whereas said three faces generally extend at 90 degrees with respect to each other.

4. The inflatable packaging structure according to claim 1 and wherein said structure includes inflatable and non-inflatable portions.

5. The inflatable packaging structure according to claim 4 and wherein said non-inflatable portions are disposed within the rectangular structure defined by said at least four faces.

6. The inflatable packaging structure according to claim 1 and wherein said rectangular structure defines a rectangular opening formed between said at least four faces.

7. The inflatable packaging structure according to claim 6, and wherein said rectangular opening is adapted for receiving a portion of an object to be protected thereinto.

* * * * *